US010900390B2

(12) United States Patent
Liskar

(10) Patent No.: US 10,900,390 B2
(45) Date of Patent: Jan. 26, 2021

(54) HARSH CONDITION CONTROLS FOR ELECTRICALLY LATCHED SWITCHING ROLLER FINGER FOLLOWER

(71) Applicant: Eaton Intelligent Power Limited, Dublin (IE)

(72) Inventor: Petr Liskar, Prague (CZ)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/628,435

(22) PCT Filed: Jun. 22, 2018

(86) PCT No.: PCT/US2018/038935
§ 371 (c)(1),
(2) Date: Jan. 3, 2020

(87) PCT Pub. No.: WO2019/010013
PCT Pub. Date: Jan. 10, 2019

(65) Prior Publication Data

US 2020/0165946 A1 May 28, 2020

Related U.S. Application Data

(60) Provisional application No. 62/528,756, filed on Jul. 5, 2017.

(51) Int. Cl.

| | |
|---|---|
| ***F01L 13/00*** | (2006.01) |
| ***F01L 1/18*** | (2006.01) |
| *F01L 1/24* | (2006.01) |

(52) U.S. Cl.
CPC ..... *F01L 13/0005* (2013.01); *F01L 1/185* (2013.01); *F01L 1/2405* (2013.01); (Continued)

(58) Field of Classification Search
CPC ..... F01L 1/185; F01L 2001/186; F01L 1/46; F01L 9/04; F01L 2009/0423; (Continued)

(56) References Cited

U.S. PATENT DOCUMENTS

2008/0006232 A1* 1/2008 Gregor ..... F01L 13/0036 123/90.15
2017/0183982 A1* 6/2017 Hughes ..... F01L 1/267
2017/0241300 A1* 8/2017 Liskar ..... F01L 1/2405

FOREIGN PATENT DOCUMENTS

WO WO-2016028812 A1 * 2/2016 ..... F01L 1/185

* cited by examiner

*Primary Examiner* — Jorge L Leon, Jr.
(74) *Attorney, Agent, or Firm* — Paul V. Keller

(57) ABSTRACT

A method of operating an electromagnetic latch assembly of a type that includes an electromagnet and a latch pin that is stable independently from the electromagnet in both first and second positions includes energizing the electromagnet systematically over a period in a manner that enhances the functionality of the electromagnetic latch assembly without causing the latch pin to move between the first and second positions. The period may be a period over which the electromagnetic latch assembly is too cold and the electromagnet may be energized in a manner that is effective for heating. Alternatively, the period may be one over which the electromagnetic latch assembly is subject to high inertial forces and the electromagnet may be energized in a manner that is effective to enhance latch pin retention.

18 Claims, 4 Drawing Sheets

(52) U.S. Cl.
CPC ... *F01L 2001/186* (2013.01); *F01L 2013/001* (2013.01); *F01L 2013/101* (2013.01); *F01L 2305/00* (2020.05); *F01L 2820/01* (2013.01)

(58) Field of Classification Search
CPC ..... F01L 2009/0446; F01L 2009/0448; F01L 13/0005; F01L 2013/001; F01L 2013/101; F01L 2013/116; F01L 2800/01; F01L 2820/031; F01L 2820/044
USPC ..... 123/90.39, 90.41
See application file for complete search history.

HARSH CONDITION CONTROLS FOR ELECTRICALLY LATCHED SWITCHING ROLLER FINGER FOLLOWER

FIELD

The present disclosure relates to control methods for electromagnetic latch assemblies of a certain type in motor vehicle applications.

BACKGROUND

Some rocker arm assemblies in valvetrains of internal combustion engines use latches to implement variable valve lift (VVL) or cylinder deactivation (CDA). For example, some switching roller finger followers (SRFF) use hydraulically actuated latches. In these systems, pressurized oil from an oil pump may drive latch actuation. The flow of pressurized oil may be regulated by an oil control valve (OCV) under the supervision of an Engine Control Unit (ECU). A separate feed from the same source provides oil for hydraulic lash adjustment. This means that each rocker arm has two hydraulic feeds, which entails a degree of complexity and equipment cost. The oil demands of these hydraulic feeds may approach the limits of existing supply systems.

In view of these considerations, there has been a growing interest in electromagnetic latches for valvetrain systems. Electromagnetic latches may have faster switching times than hydraulically actuated latches. Another advantage is that electromagnetic latches are generally operational at lower temperatures than are hydraulic actuated latches.

SUMMARY

One aspect of the present disclosure is a method of operating an electromagnetic latch assembly of a type that includes an electromagnet that is operative to actuate the latch pin between first and second positions when current through the electromagnet is suitably varied. The first and second positions may relate to latched and unlatched positions for the electromagnetic latch assembly. The method includes energizing the electromagnet systematically over a period in a manner that enhances the functionality of the electromagnetic latch assembly without causing the latch pin to move between the first and second positions. In some of these teachings, the period is a period over which the electromagnetic latch assembly is too cold and the electromagnet is energized in a manner that is effective for heating. In some of these teachings, the period is a period over which the electromagnetic latch assembly is subject to high inertial forces and the electromagnet is energized in a manner that is effective to enhance latch pin retention.

The methods of the present disclosure are particularly adapted to electromagnetic latch assemblies in which the latch pin is stable independently from the electromagnet in both first and second positions. In some of these teachings, the electromagnet is operative to actuate the latch pin from the first position to the second position or from the second position to the first position when energized with a DC current, the direction of actuation depending on the polarity of the DC current. The type of electromagnetic latch assembly is often not energized and leaves open the capacity for being energized to be heated without moving the latch pin or for being energized to enhance latch pin retention.

Most vehicle emission occur within the first few minutes of startup due to the exhaust aftertreatment system being cold. Cylinder deactivation can be used to increase exhaust temperatures and thereby accelerate heating of the exhaust aftertreatment system; therefore, the ability to actuate electromagnetic latches implementing cylinder deactivation within a short period following cold start could lead to a significant reduction in overall emissions. Although electromagnetic latches are operational at lower temperatures than hydraulically actuated latches, oil viscosity may prevent electromagnetic latches from operating immediately after startup particularly during cold weather. The present teachings provide methods of heating the latches to allow cylinder deactivation to begin sooner. In some of these teachings, temperature measurements are made and used to determine the period over which energy is supplied to the electromagnet to effectuate heating. Although a DC current is used for actuation, in some of these teachings the electromagnet is energized with an AC current to effectuate heating.

It is known that latching rocker arm assemblies occasionally undergo a "critical shift". A critical shift is an event in which the latch pin of a rocker arm assembly slips while the rocker arm is being lifter by a cam. A torsion spring may return the rocker arm that was restrained by the latch pin to base circle in a violent motion that may cause significant wear. Critical shift sometimes results from a latch pin not fully engaging due to actuation failing to complete while the rocker arm assembly is on base circle. That is less likely to occur with an electromagnetic latch than with a hydraulic latch because the electromagnetic latch generally has a shorter actuation time.

Nevertheless, the pin of an electromagnetic latch may be driven into or out of engagement by a very large inertial force. The latch is unlikely to be subject to an inertial force of sufficient magnitude to dislodge the latch pin except under extraordinary conditions. According to the present teachings, one of those extraordinary conditions is detected and the electromagnet is energized systematically over a period in response to that detection in a manner that enhances retention of the latch pin position. In some of these teachings, a knock sensor is used to detect the condition. In some of these teachings, an inertial sensor is used to detect the condition. In some of these teachings, the condition relates to an engine operating within a predetermined speed-load regime. The electromagnet may be energized in a manner that depends on the current latch pin position.

In some of these teachings, when the electromagnet of the electromagnetic latch assembly is energized with a DC current in a first direction, it is operative to actuate the latch pin from the first position to the second position provided that the DC current is of sufficient magnitude and is maintained for a sufficient period. When the electromagnet is energized with a DC current in a reverse of the first direction, it is operative to actuate the latch pin from the second position to the first position. On the other hand, according to the present teachings it is desirable to energize the electromagnet while retaining the latch pin position. The present teachings provide several ways in which this may be accomplished.

In some aspects of the present teachings, the current latch pin position is determined and the electromagnet is energized with a DC current having a polarity selected to maintain the current latch pin position based on that determination. In some of these teachings, the determination is made on the basis of the electromagnetic latch assembly having been operated to actuate the latch pin to that position. In some of these teachings, that determination is made on the basis of a diagnostic test.

In some of the present teachings, the electromagnet is energized with a current having a magnitude insufficient to actuate the latch pin. The current may be generated by driving the electromagnet with a voltage substantially lower than the voltage used to actuate the latch pin. In some of these teachings, the electromagnet is energized with a series of pulses. Each pulse may be too brief to actuate the latch pin. The pulses may be repeated periodically. In some of these teachings, the periodicity provides the electromagnet with a duty cycle in the range from 10% to 75%. In addition to preventing latch pin actuation, pulsing may be desirable to prevent the electromagnet from overheating. Overheating may be a concern even over the course of a heating operation: it may be necessary to allow time for some of the heat generated within the electromagnet to spread to other parts of the electromagnetic latch assembly before heating can be continued.

The methods of the present disclosure may be used with an electromagnetic latch assembly that has dual latch pin position stability independently from the electromagnet. In some of these teachings, the electromagnetic latch assembly includes a permanent magnet operative to stabilize the latch pin in both the first and second latch pin positions. In some of these teachings, the permanent magnet is mounted to a component distinct from the latch pin, whereby the permanent magnet is stationary relative to the electromagnet. This structure increases actuation speed and reduces power requirements by keeping the weight of the permanent magnet off the latch pin.

Power requirements may be reduced by structuring the latch to operate through a magnetic circuit shifting mechanism. In some of these teachings, absent any magnetic fields generated by the electromagnet or other external sources, when the latch pin is in the first position, an operative portion of the magnetic flux from the permanent magnet follows a first magnetic circuit and when the latch pin is in the second position, an operative portion of the magnetic flux from the permanent magnet follows a second magnetic circuit distinct from the first magnetic circuit. The electromagnet may be operative to redirect the permanent magnet's flux away or toward one or the other of these magnetic circuits and thereby cause the latch pin to actuate. In some of these teachings redirecting the magnetic flux includes reversing the magnetic polarity in a magnetic material forming part of both the first and second magnetic circuits. An electromagnetic latch assembly structured to be operable through a magnetic circuit shifting mechanism may be smaller than one that is not so structured.

In some of these teaching, the electromagnet encircles a volume within which a portion of the latch pin comprising magnetically susceptible material translates and the electromagnetic latch assembly includes magnetically susceptible material on an outer side of the coil that is distal from the encircled volume. Both the first and the second magnetic circuits pass through the portion of the latch pin formed of magnetically susceptible material. In some of these teachings, the first magnetic circuit passes through the material on the outer side of the coil while the second magnetic circuit does not pass through the material on outer side of the coil. This characteristic of the second magnetic circuit reduces magnetic flux leakage and increases the holding force per unit mass provided by the permanent magnet when the latch pin is in the second position.

In some of these teachings, the electromagnetic latch assembly includes a second permanent magnet fulfilling a complimentary role to the first. The electromagnetic latch assembly may provide two distinct magnetic circuits for the second permanent magnet, one or the other of which is the path taken by an operative portion of the magnet flux from the second permanent magnet depending on the whether the latch pin is in the first position or the second position. The path taken when the latch pin is in the second position may pass around through the material on the outer side of the coil. The path taken when the latch pin is in the first position may be a shorter path that does not pass through the outer side of the coil. One or the other of the permanent magnets may then provide a high holding force depending on whether the latch pin is in the first or second the position. In some of these teachings, both permanent magnets contribute to the positional stability of the latch pin in both the first and the second latch pin positions. In some of these teachings, the two magnets are arranged with confronting polarities. In some of these teachings, the two magnets are located at distal ends of the volume encircled by the electromagnet. In some of these teachings, the permanent magnets are annular in shape and polarized along the directions of their axis. These structures may be conducive to providing a compact and efficient design.

The primary purpose of this summary has been to present certain of the inventors' concepts in a simplified form to facilitate understanding of the more detailed description that follows. This summary is not a comprehensive description of every one of the inventors' concepts or every combination of the inventors' concepts that can be considered "invention". Other concepts of the inventors will be conveyed to one of ordinary skill in the art by the following detailed description together with the drawings. The specifics disclosed herein may be generalized, narrowed, and combined in various ways with the ultimate statement of what the inventors claim as their invention being reserved for the claims that follow.

DETAILED DESCRIPTION

Figure 1:
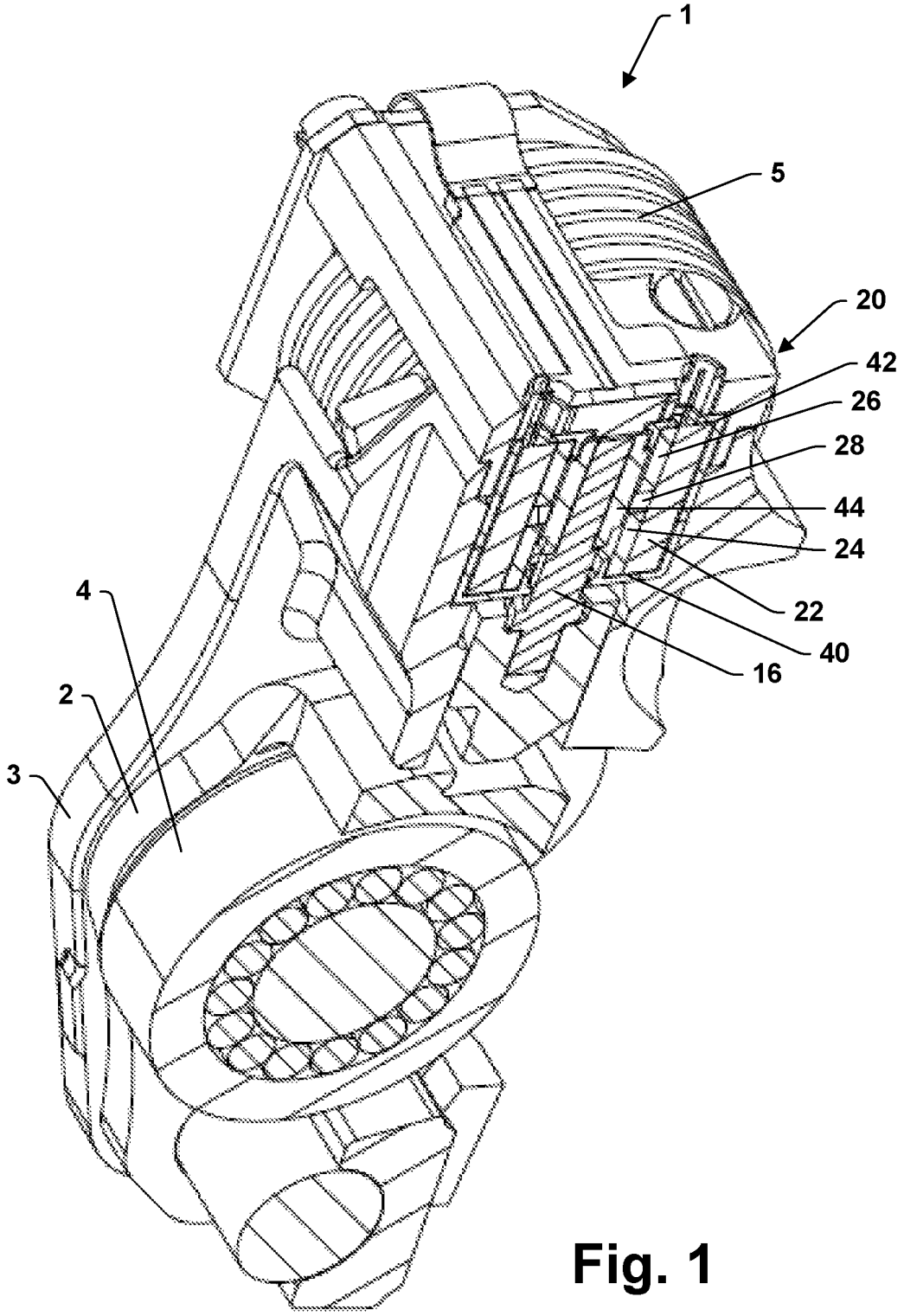
FIG. 1 is a perspective view on a cross-section of a rocker arm assembly with an electromechanical latch assembly suitable for use with the present teachings.

FIG. 1 illustrates a cylinder deactivating rocker arm assembly 1 that may be used in a valvetrain in an engine of a vehicle. Rocker arm assembly 1 include an inner arm 2 and an outer arm 3 that are selectively engaged by a latch pin 16 of electromagnetic latch assembly 20, which may be operated in accordance with the present teachings. Electromagnetic latch assembly 20 includes an electrical coil 22, which is an electromagnet and is operable with a DC current in a first direction to actuate latch pin 16 from an engaging (latched) to a non-engaging (unlatched) position and with a DC current in the reverse direction to actuate latch pin 16 in the opposite way, from the non-engaging position to the engaging position. With latch pin 16 in the engaging position, actuating rocker arm assembly 1 through cam follower 4 is operative to open a valve (not shown). With latch pin 16 in the non-engaging position, actuating rocker arm assembly 1 through cam follower 4 causes inner arm 2 to pivot and torsion spring 5 to wind, but leaves outer arm 3 stationary and the valve closed.

Figure 2:
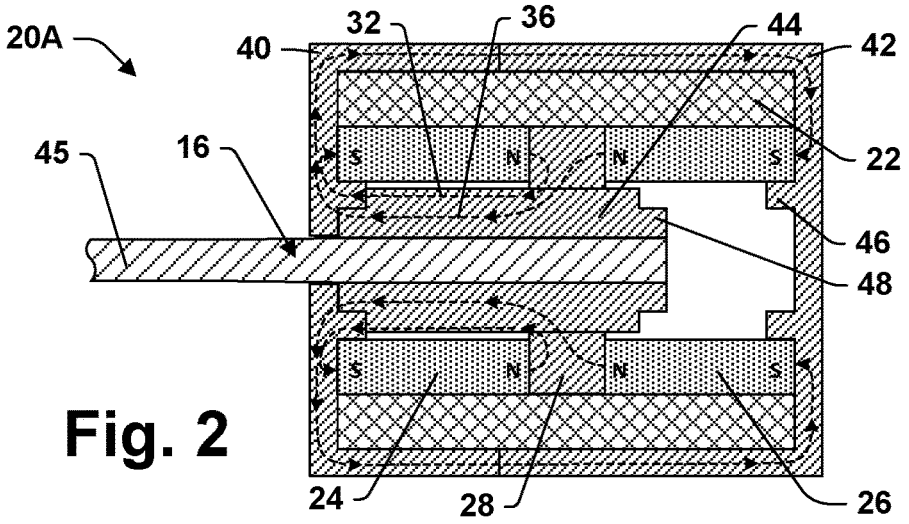
FIG. 2 is a sketch of the electromechanical latch assembly of the rocker arm of FIG. 1.
Figure 3:
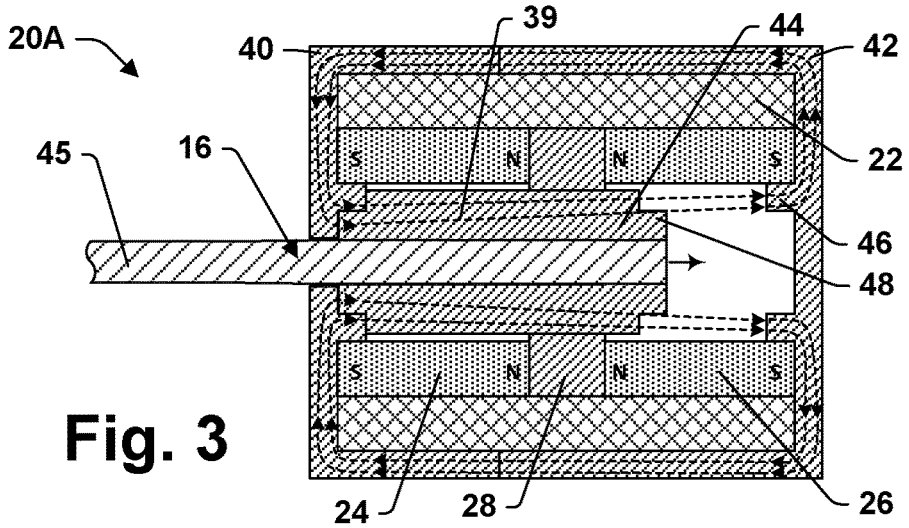
FIG. 3 provides the same view as FIG. 2, but illustrating magnetic flux that may be generated by the electromagnet.
Figure 4:
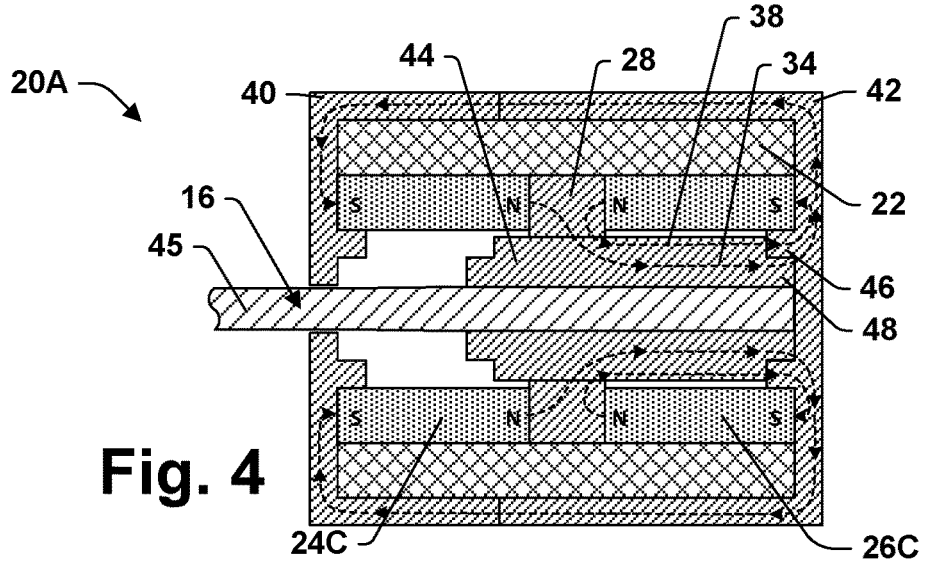
FIG. 4 provides the view of FIG. 2 but with the latch pin translated from a first position to a second position.

FIGS. 2-4 illustrate an electromagnetic latch assembly 20A. The description of electromagnetic latch assembly 20A is fully applicable to electromagnetic latch assembly 20, which has corresponding parts. FIG. 2 illustrates electromagnetic latch assembly 20A with latch pin 16 in a first position, which is a first limit of travel for latch pin 16. FIG. 4 illustrates electromagnetic latch assembly 20A with latch pin 16 in a second position, which is a second limit of travel for latch pin 16. Coil 22 is operative to cause latch pin 16 to translate between the first and the second position. FIG. 3 illustrates the magnet field generated by coil 22 to initiate the transition between the first and the second position.

Permanent magnets 24 and 26 are each operative to stabilize the position of latch pin 16 in each of the first and second positions. As illustrated in FIGS. 2 and 4, permanent magnets 24 and 26 utilize different magnetic circuits depending on whether latch pin 16 is in the first or the second position. Pole pieces 40 and 42 form a clam shell around coil 22, which completes some of these magnetic circuits. Latch pin 16 has a magnetically susceptible ferrule 44 around a paramagnetic core 45. Ferrule 44 is within these magnetic circuits and is the part through which permanent magnets 24 and 26 exert forces on latch pin 16. Magnetic circuits have characteristics as described herein, but it should be appreciated that the illustrations of these circuits are only approximate.

For the purposes of this disclosure, a paramagnetic material is one that does not interact strongly with magnetic fields. Aluminum is an example of a paramagnetic material. A magnetically susceptible material is generally a low coercivity ferromagnetic material. Pole pieces 28, 40, and 42 and ferrule 44 are all made from low coercivity ferromagnetic material. Soft iron is an example of a low coercivity ferromagnetic material.

As shown in FIG. 2, magnetic circuit 32 is the primary path for an operative portion of the magnetic flux from magnet 24 when latch pin 16 is in the first position, absent magnetic fields from coil 22 or any external source that might alter the path taken by flux from magnet 24. The operative portion of the flux is that portion of the magnetic flux which contributes to the stability of latch pin 16 in its current position. Magnetic circuit 32 proceeds from the north pole of magnet 24, through pole piece 28, through ferrule 44, through an edge of pole piece 40, and ends at the south pole of magnet 24. Perturbation of latch pin 16 from the first position would introduce an air gap into magnetic circuit 32, increasing its magnetic reluctance. The magnetic forces produced by magnet 24 resist such perturbations.

As shown in FIG. 4, when latch pin 16 is in the second position, magnetic circuit 34 becomes the primary path for an operative portion of the magnet flux from magnet 24. Magnetic circuit 34 proceeds from the north pole of magnet 24, through pole piece 28, through ferrule 44, through pole piece 42, through pole pieces 40, and ends at the south pole of magnet 24. Perturbations of latch pin 16 from the second position would introduce an air gap into magnetic circuit 34, increasing its magnetic reluctance. The magnetic forces produced by magnet 24 resist such perturbations.

Figure 5:
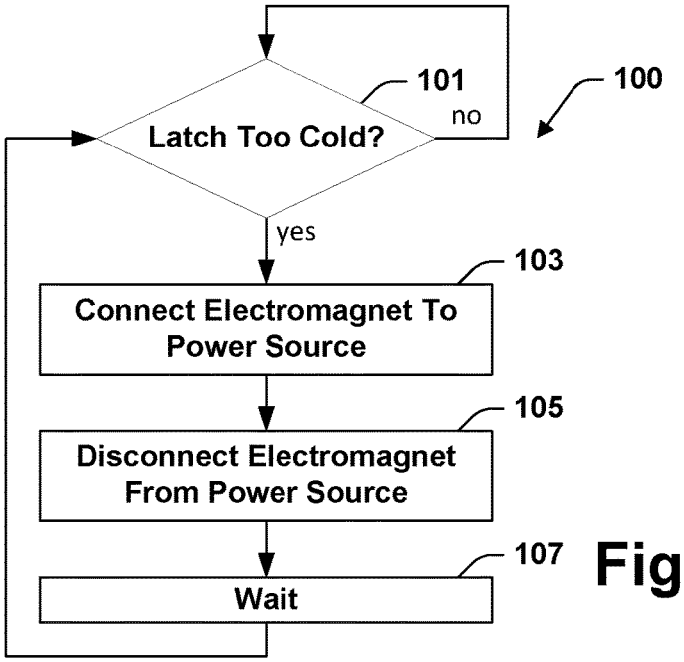
FIG. 5 is a flow chart of a method in accordance with some aspects of the present teachings.

As shown in FIG. 5, when latch pin 16 is in the second position, magnetic circuit 34 becomes the primary path for an operative portion of the magnet flux from magnet 24. Magnetic circuit 34 proceeds from the north pole of magnet 24, through pole piece 28, through ferrule 44, through pole piece 42, through pole pieces 40, and ends at the south pole of magnet 24. Perturbations of latch pin 16 from the second position would introduce an air gap into magnetic circuit 34, increasing its magnetic reluctance. The magnetic forces produced by magnet 24 resist such perturbations.

Magnet 26 is also operative to stabilize latch pin 16 in both the first and the second positions. As shown in FIGS. 2 and 4, magnetic circuit 36 is the primary path for an operative portion of the magnet flux from magnet 26 when latch pin 16 is in the first position and magnetic circuit 38 is the primary path for an operative portion of the magnet flux from magnet 26 when latch pin 16 is in the second position.

Magnetic circuits 34 and 36 pass through portions of pole pieces 40 and/or 42 that are outside the perimeter of coil 22. Magnetic circuits 32 and 38 do not. Magnetic circuits 32 and 38 are comparatively short resulting in low magnetic flux leakage and a high holding force for latch pin 16. Having one of these circuits active for each of the first and second positions helps ensure that latch pin 16 is securely held.

Electromagnetic latch assembly 20A is structured to operate through a magnetic flux shifting mechanism. In accordance with the flux shifting mechanism, coil 22 is operable to alter the path taken by flux from permanent magnets 24 and 26. FIG. 3 illustrates the mechanism for this action in the case of operating coil 22 to induce latch pin 16 to actuate from the first position to the second position. A voltage of suitable polarity may be applied to coil 22 to induce magnetic flux following the circuit 39. This magnetic flux reverses magnetic polarities in ferrule 44 and pole pieces 40 and 42. This greatly increases the reluctance of magnetic circuits 32 and 36 (see FIG. 2) causing magnetic flux to shift away from those circuits and toward magnetic circuits 34 and 38 (see FIG. 4). The net magnetic forces on latch pin 16 may drive it to the second position shown in FIG. 4. Notably, the total air gap in the magnetic circuit 39 (see FIG. 5) taken by flux from coil 22 does not vary as latch pin 16 actuates. This feature relates to operability through a flux shifting mechanism.

A consequence of the flux shifting mechanism is that electromagnetic latch assembly 20A does not need to do work on latch pin 16 throughout its traverse from the first position to the second position or vice versa. While permanent magnets 24 and 26 may initially hold latch pin 16 in the first position, at some point during latch pin 16's progress toward the second position permanent magnets 24 and 26 begin to attract latch pin 16 toward the second position.

Ferrule 44 has a stepped edge 48 that mates with a stepped edge 46 of pole piece 42 as latch pin 16 moves into the second position. As shown in FIG. 3, when coil 22 is operated to actuate latch pin 16 from the first position to the second position magnetic flux generated by coil 22 crosses between stepped edge 48 and stepped edge 46. As shown in FIG. 4, magnetic flux from permanent magnets 24 and 26 also crosses between stepped edges 46 and 48 when the flux from these magnets follows magnetic circuits 34 and 38. Forming these mating surfaces with stepped edges 46 and 48 increases the magnitude of the magnetic forces that draw latch pin 16 into the second position over a range of latch pin travel.

Coil 22 may be powered by circuitry (not shown) that allows the polarity of a voltage applied to coil 22 to be reversed. A conventional solenoid switch forms a magnetic circuit that includes an air gap, a spring that tends to enlarge the air gap, and an armature moveable to reduce the air gap.

Moving the armature to reduce the air gap reduces the magnetic reluctance of that circuit. Consequently, energizing a conventional solenoid switch causes the armature to move in the direction that reduces the air gap regardless of the direction of the current through the solenoid's coil or the polarity of the resulting magnetic field. As described above, however, latch pin 16 may be moved in either one direction or another depending on the polarity of the magnetic field generated by coil 22. Circuitry, an H-bridge for example, allows the polarity of the applied voltage to be reversed and enables electromagnetic latch assembly 20 to actuate latch pin 16 to either the first or the second position.

FIG. 5 provides a flow chart of a method 100 providing an example in accordance with some aspects of the present teachings. Method 100 may be used to operate electromagnetic latch assembly 20 of rocker arm assembly 1. Method 100 begins with action 101, determining whether electromagnetic latch assembly 20 is potentially too cold to operate with sufficient reliability or speed. Latch actuation time generally decreases with increasing temperature. Electromagnetic latch assembly 20 may be considered "too cold" if it is unable to actuate within a pre-specified minimum elapsed time. In some of these teachings, electromagnetic latch assembly 20 is considered "too cold" if it is below a pre-specified minimum operating temperature. The determination that the latch is too cold may be made in any suitable manner. For example, if an oil temperature is available, it may be presumed that electromagnetic latch assembly 20 is at that temperature and the oil temperature may be compared to the pre-specified minimum operating temperature to determine whether the latch is too cold.

The size and power requirement for coil 22 depends strongly on the specification for the operating temperature range over which electromagnetic latch assembly 20 is to be operable. A typical specification would require operability down to 20° C. A more stringent specification would require operability down to 0° C. In view of the present teachings, however, those specifications may be relaxed allowing coil 22 to be smaller and less expensive. Accordingly, electromagnetic latch assembly 20 may have a minimum operating temperature of 25° C. or higher in conjunction with SAE 10 W-40 motor oil. If electromagnetic latch assembly 20 is potentially too cold to operate with sufficient reliability or speed, method 100 proceeds with actions 103, 105, and 107, which may be used in any suitable combination to effectuate heating of electromagnetic latch assembly 20.

If electromagnetic latch assembly 20 is too cold, method 100 proceeds with action 103, which begins a heating operation. A heating operation is a procedure that heats electromagnetic latch assembly 20 to a significant degree or to at least a predetermined temperature. 10° C. or more would considered a significant degree of heating. In some of these teachings electromagnetic latch assembly 20 is heated until it reaches at least predetermined temperature. In others of these teachings, the heating operation is characterized by a power cycle. The power cycle would be one that is expected to result in electromagnetic latch assembly 20 being heated to a significant degree.

Action 103 is connecting a circuit that include coil 22 to a power source (not shown). The power source may be either an AC or DC voltage source. If the power source is a DC power source, its polarity may be selected to increase the force with which latch pin 16 is held in its current position. On the other hand, if the DC power source has a sufficiently low voltage or is connected in sufficiently short and spaced apart pulses, then selecting the polarity in relation to the current position of latch pin 16 is optional.

Action 105 is disconnecting the circuit that includes coil 22 from the power source. The timing of action 105 depends on its purpose. In some of these teachings, coil 22 is disconnected from its power source to ensure that latch pin 16 does not move from its current position. In some of these teachings, coil 22 is disconnected from its power source to ensure that coil 22 does not overheat. Coil 22 may also be disconnected from its power source because a heating operation is believed to be completed.

Action 107 is a waiting operation. The necessity of action 107 and its duration depend on the purpose for disconnecting coil 22 from its power source. In some of these teachings, waiting 107 is a fixed period between voltage pulses. In some of these teachings, waiting 107 is selected in view of the rate of heat transfer between coil 22 and surrounding structures. For example, there may be a time constant that characterizes the rate at which heat from coil 22 dissipates to the rest of electromagnetic latch assembly 20 and portions of rocker arm assembly 1 that are in intimate contact with electromagnetic latch assembly 20. The waiting period may be selected in view of that time constant.

Actuating electromagnetic latch assembly 20 with a 13V DC power source typically requires at least 3 milliseconds of power application. In some of these teachings, actuation is precluded by restricting power coupling to intervals ⅓ or less the time required for actuation. In some of these teachings, the periods are 1 millisecond or less. The periods between these pulses may be selected to provide a duty cycle in the range from 10% to 70%. It is generally unnecessary to use a duty cycle less than 10%. A duty cycle greater than 70% may be too high to prevent latch actuation. A typical duty cycle that avoids the risk of unintentional latch actuation is 50%.

If the voltage polarity is selected to prevent latch actuation, higher duty cycles and longer periods of voltage application may be used. However, electromagnetic latch assembly 20 is designed to operate through brief voltage pulses. In some of these teachings, continuous application of the power used for latch actuation will cause coil 22 to overheat in less than one minute. Typically, continuous application of the power to coil 22 will cause it to overheat in six seconds. Duty cycles in the range from 10% to 70% may also be suitable to prevent overheating.

In some of these teachings, actuation is precluded by restricting the current to coil 22 to half or less the current required to actuate latch pin 16. Electromagnetic latch assembly 20 typically requires a 1.5 amp current to actuate. Restricting the current to 0.5 amps may be effective to prevent latch pin 16 from actuating.

Figure 6:
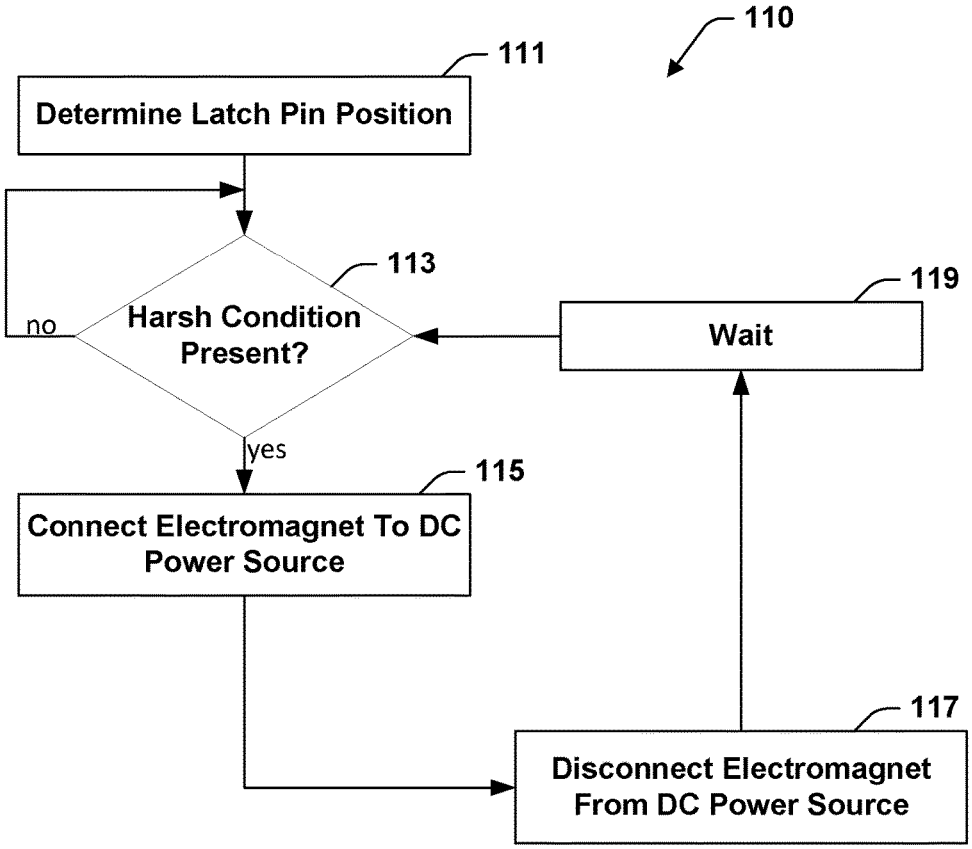
FIG. 6 is a flow chart of a method in accordance with some other aspects of the present teachings.

FIG. 6 provides a flow chart of a method 110 providing an example in accordance with some other aspects of the present teachings. Method 110 begins with action 111, determining the current position of latch pin 16. That determination may be made before that information is required in order to increase response time for subsequent steps of method 110. The position may be determined most easily by recording the expected position at the conclusion of an operation in which electromagnetic latch assembly 20 was operated in a manner intended to actuate latch pin 16. Alternatively, the position of latch pin 16 may be determined using a diagnostic device provided for that purpose. In some of these teachings, the latch pin position is determined based on a detection of the valve lift profile over a cam cycle. In some of these teachings, a circuit comprising coil 22 is pulsed and the circuit response is used to determine the latch pin position.

Action 113 is determining the presence of a harsh condition. In this context, a harsh condition is an exceptional condition that may result in a high inertial force on latch pin 16 along a direction in which latch pin 16 is free to translate. A force of 25 G or more would be considered a high inertial force. Such a force might occur in connection with excess vibration. A knock sensor installed and operative to detect engine vibration may be used to detect the harsh condition. Another alternative is to detect the force with an inertial sensor. The inertial sensor could be one provided to control braking. A further alternative is to detect the condition inferentially based on the engine operating regime. Certain extreme speed-load combinations may be known to potentially cause excessive vibration.

If a harsh condition is detected, method 110 proceeds with actions 115, 117, and 121, which may be used in any suitable combination to enhance the retention of latch pin 16 in its current position as long as the harsh condition is present. Action 115 is coupling a circuit comprising coil 22 to a DC power source. The polarity of the voltage applied to coil 22 may be selected based on the latch pin position determination of action 111.

Action 117 is disconnecting the circuit that includes coil 22 from the power source. The timing of action 117 depends on its purpose. It is possible for coil 22 may be powered continuously as long as the harsh condition is present, in which case action 117 may be trigger based on the harsh condition having passed. In some of these teachings, action 117 is triggered by a determination that coil 22 is in danger of overheating. Action 119 is waiting. Waiting may be for a period over which coil 22 is allowed to cool. In some of these teachings, action 115, 117, and 119 are applied repeatedly to provide pulsed operation of coil 22.

Pulsed operation of coil 22 may be effective to provide continuous latch pin retention. When coil 22 is activated, it increases polarization of ferromagnetic materials throughout magnetic circuit through which latch pin 16 is retained in positions. This magnetization is maintained for a period after coil 22 is disconnected from its power source. With a sufficiently high pulse frequency, the enhanced magnetic force on latch pin 16 may be maintained continuously. Pulsed operation may be useful to prevent coil 22 from overheating over an extended period through which a harsh condition may persist. A duty cycle in the range from 10% to 70% may be suitable for this mode of operation.

Figure 7:
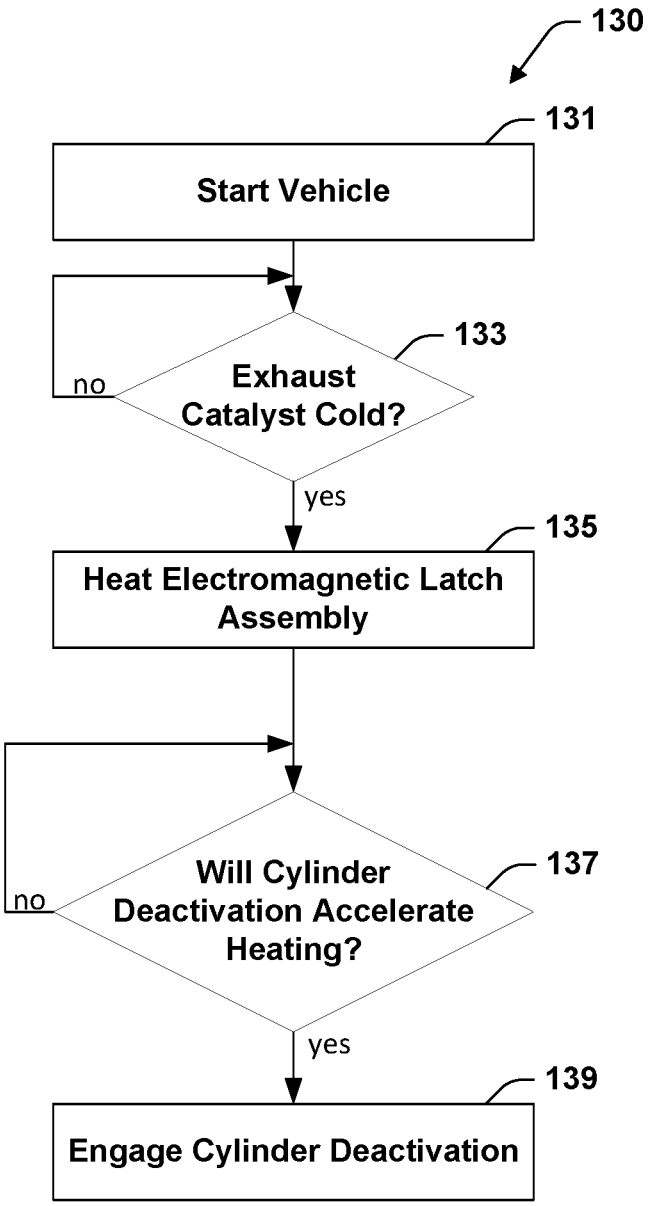
FIG. 7 is a flow chart of a method of operating a vehicle in accordance with some aspects of the present teachings

FIG. 7 is a flow chart of a method 130 providing an example of a method of operating a vehicle in accordance with some aspects of the present teachings. Method 130 generally begins with action 131, starting the vehicle. Action 133 determines whether the exhaust catalyst is too cold to be effective. That determination may be made based on a temperature measurement. The temperature could be measured in the exhaust system, but information that shows the vehicle has just undergone a cold start is sufficient to establish a need to heat the exhaust system catalyst.

Action 135 is heating an electromagnetic latch assembly 20 that controls cylinder deactivation. Heating may be carried out by a method according to the present teachings, such as method 100. After electromagnetic latch assembly 20 has been heated sufficiently to operate, method 130 continues with action 137 determining whether cylinder deactivation will accelerate heating of an exhaust aftertreatment device.

Cylinder deactivation increases exhaust temperatures while reducing exhaust flow rate. During a short period immediately following cold start, the decrease in exhaust flow rate may offset the increased exhaust temperature to result in little net effect on the exhaust catalyst heating rate. However, a point is soon reached where the benefit of the higher exhaust temperature is the predominant one. In some of these teachings, the heating operation of action 135 is completed before that point is reached. Action 137 determined the arrival of that point and initiates action 139, which is deactivating one or more engine cylinders.

The components and features of the present disclosure have been shown and/or described in terms of certain embodiments and examples. While a particular component or feature, or a broad or narrow formulation of that component or feature, may have been described in relation to only one embodiment or one example, all components and features in either their broad or narrow formulations may be combined with other components or features to the extent such combinations would be recognized as logical by one of ordinary skill in the art.

The invention claimed is:

1. A method of operating an electromagnetic latch assembly of a type that includes a latch pin and an electromagnet that is operative to actuate the latch pin between latched and unlatched positions when current through the electromagnet is suitably varied, the method comprising:

heating the electromagnetic latch assembly by at least 10° C. by providing the electromagnet with a current that does not actuate the latch pin.

2. The method according to claim 1, wherein the current is a first DC current, and the method further comprises:

subsequently actuating the latch pin between the latched and unlatched positions by providing the electromagnet with a second DC current that has an opposite polarity from the first DC current.

3. The method according to claim 1, further comprising:

energizing the electromagnet with a DC current in a first direction so as to actuate the latch pin from the latched position to the unlatched position; and energizing the electromagnet with a DC current in a second direction that is opposite of the first direction so as to actuate the latch pin from the unlatched position to the latched position;

wherein the electromagnetic latch assembly stabilizes the latch pin in both the latched and unlatched positions independently from the electromagnet.

4. The method according to claim 3, wherein:

the electromagnetic latch assembly comprises a permanent magnet operative to stabilize the latch pin in both the latched and unlatched positions; and the permanent magnet is stationary relative to the electromagnet.

5. The method according to claim 4, wherein:

with the latch pin in the latched position, the electromagnetic latch assembly forms a first magnetic circuit that is operative to be a primary path for magnetic flux from the permanent magnet;

with the latch pin in the unlatched position, the electromagnetic latch assembly forms a second magnetic circuit distinct from the first magnetic circuit, that is operative to be the primary path for magnetic flux from the permanent magnet;

the electromagnet is a coil that encircles a volume within which a portion of the latch pin comprising magnetically susceptible material translates;

the electromagnetic latch assembly comprises magnetically susceptible material on an outer side of the coil that is distal from the encircled volume;

both the first and the second magnetic circuits each include the portion of the latch pin;

the second magnetic circuit passes through the magnetically susceptible material on the outer side of the coil; and the first magnetic circuit does not pass through the magnetically susceptible material on the outer side of the coil.

6. The method according to claim 1, wherein the current is a DC current.

7. The method according to claim 1, further comprising: determining a position of the latch pin; and wherein the current is a DC current having a polarity selected based on the position of the latch pin.

8. The method according to claim 1, wherein the current is a first DC current, and the method further comprises subsequently actuating the latch pin between the latched and unlatched positions by providing the electromagnet with a second DC current that has a greater magnitude than the first DC current.

9. The method according to claim 1, wherein the current is pulse width modulated.

10. The method according to claim 1, wherein the current is an AC current.

11. The method according to claim 1, wherein the current is a first DC current; and the method further comprises:

subsequently actuating the latch pin between the latched and unlatched positions by applying a second DC current to the electromagnet, wherein the second DC current has an opposite polarity from the first DC current.

12. The method according to claim 1, wherein, the heating of the electromagnetic latch assembly is based on a temperature of the electromagnetic latch assembly being determined to be less than or equal to a predetermined temperature.

13. A method of operating a vehicle of a type that includes an internal combustion engine having cylinders and an electromagnetic latch assembly operative to deactivate one of the cylinders, the method comprising:

upon a cold start of the engine, heating the electromagnetic latch assembly by the method of claim 1; and operating the electromagnetic latch assembly so as to deactivate the one of the cylinders.

14. The method according to claim 13, wherein the current is a first DC current.

15. A method of operating an electromagnetic latch assembly of a type that includes a latch pin and an electromagnet that is operative to actuate the latch pin between latched and unlatched positions when current through the electromagnet is suitably varied, the method comprising:

determining an inertial force on the latch pin; and providing a current to the electromagnet sufficient to counter the inertial force and keep the latch pin stationary.

16. The method according to claim 15, wherein the inertial force is determined from an engine speed-load regime or the inertial force is detected using a knock sensor or an inertial sensor.

17. The method according to claim 15, further comprising:

energizing the electromagnet with a DC current in a first direction so as to actuate the latch pin from the latched position to the unlatched position; and energizing the electromagnet with a DC current in a second direction that is opposite of the first direction so as to actuate the latch pin from the unlatched position to the latched position;

wherein the electromagnetic latch assembly stabilizes the latch pin in both the latched and unlatched positions independently from the electromagnet.

18. The method according to claim 15, wherein the current is a DC current.

* * * * *